US005548311A

United States Patent [19]

Hine

[11] Patent Number: 5,548,311

[45] Date of Patent: Aug. 20, 1996

[54] MOUNT FOR REPLACEABLE INK JET HEAD

[75] Inventor: Nathan P. Hine, South Strafford, Vt.

[73] Assignee: Spectra, Inc., Hanover, N.H.

[21] Appl. No.: 204,463

[22] Filed: Feb. 28, 1994

[51] Int. Cl.[6] ..... B41J 2/235

[52] U.S. Cl. ..... 347/50; 347/87

[58] Field of Search ..... 347/49, 50, 86, 347/87

[56] References Cited

U.S. PATENT DOCUMENTS 5,245,361 9/1993 Kashimura ..... 347/50

*Primary Examiner*—Benjamin R. Fuller
*Assistant Examiner*—Craig A. Hallacher
*Attorney, Agent, or Firm*—Brumbaugh, Graves Donohue & Raymond

[57] ABSTRACT

In the embodiments disclosed in the specification, a mounting arrangement for a replaceable ink jet head on a reciprocating carriage includes corresponding mounting pads on a rearwardly-facing surface of the carriage and on a forwardly-facing surface of the ink jet head and resilient electrical contacts on a rearwardly-facing surface of the ink jet head. In one embodiment, a clamp arrangement engages the rearwardly-facing surface of the ink jet head and includes a plurality of electrical contacts for engaging the electrical contacts on the rearwardly-facing surface of the ink jet head. In another embodiment, the reciprocating carriage includes a recess which extends parallel to the direction of reciprocating motion and has mounting pads in a rearwardly-facing surface and the ink jet head has a mounting portion with forwardly-facing mounting pads to engage the rearwardly-facing mounting pads of the carriage and includes rearwardly-facing resilient electrical contacts to engage forwardly-facing resilient electrical contacts in a rear surface of the recess and the carriage includes a clamp arrangement to urge the mounting portion of the ink jet head forwardly to force the mounting pads on the carriage and on the ink jet head into engagement.

7 Claims, 1 Drawing Sheet

MOUNT FOR REPLACEABLE INK JET HEAD

BACKGROUND OF THE INVENTION

This invention relates to mounts for replaceable ink jet heads and, more particularly, to a new and improved ink jet head mount requiring less retention force.

In an ink jet head mounting arrangement, it is necessary to position the ink jet head precisely at a required location in a carriage which conveys the head adjacent to a substrate to be printed with ink from the head in order to assure correct printing. The retention force applied to the head to retain it in position in the carriage must be adequate to keep the head from moving or shifting under vibration, shock and acceleration forces during scanning of the head adjacent to the substrate. In addition, it is necessary to make electrical connections to the ink jet head to supply actuating signals to electromechanical ink drop ejectors and, moreover, it may also be necessary to provide fluid connections to supply ink and/or air to the ink jet head.

For rapid installation and removal of a replaceable ink jet head in a carriage, the retention device may be a handle arrangement which applies force to the ink jet head to urge it against mounting pads which locate the replaceable head in the desired position in the carriage and also against electrical contact pads through which signals are supplied to the ink jet head. A typical prior art arrangement is illustrated in FIG. 1, in which an ink jet head 10 from which ink drops 11 are selectively ejected from orifices 12 toward an adjacent substrate 13 supported on a platen 14. The ink jet head 10 is removably mounted on a carriage 15 which is guided on a bar 16 for reciprocal motion perpendicular to the plane of the drawing. In order to position the head 10 properly on the carriage 15, the head and carriage are provided with front-facing mounting pads 17 on the front surface of the head and rear-facing mounting pads 18 on an opposed surface of the carriage, which are urged into engagement by a locking handle 19 applying a forwardly-directed force to the rear surface 20 of the ink jet head.

In order to transmit electrical signals to a series of transducers 21, which are arranged to selectively eject the ink drops 11 from the series of orifices 12, the transducers are connected through corresponding wires 22 to a series of spring contacts 23 arrayed on the front surface of the head and a corresponding series of spring contacts 24 is positioned in the adjacent surface of the carriage 15 and connected to corresponding conductors 25 leading to a control unit (not shown) in which the actuating signals are generated.

With this conventional replaceable ink jet head mounting arrangement, the force applied to the head 10 by the handle 19 must be greater than the sum of the spring forces produced by the series of contacts 23 and 24 and the acceleration and shock forces which tend to separate the surfaces 17 and 18 when the ink jet head 10 is accelerated and stopped in either direction during its reciprocal motion. For example, if each spring contact combination 23 and 24 requires a force of 5 grams in order to assure proper engagement, and there are 32 ink jets in the ink jet head, the total force required to assure contact for the entire series of 32 contacts is 160 grams. Moreover, if the ink jet head 10 weighs 50 grams and is subjected to 5 G's during acceleration and stopping, then the mounting force required to maintain the head in the desired position during operation is at least 250 grams. Consequently, a total of more than 400 grams of force must be applied by the handle 19 to hold the head in the desired position.

Furthermore, if the number of jets in the ink jet head is increased, the total force required can be substantially greater. For example, if there are 96 jets in the ink jet head 10, and the spring contacts require 5 grams each to force them into the engagement position, the total required electrical contact force will be about 500 grams or more. With more jets, the head will be larger and contain more ink weighing, for example, 100 grams, which requires a head mounting force of at least 500 grams to withstand a 5 G acceleration force, so that a total force of at least 1,000 grams must be applied by the handle 19 to the rear surface 20 of the head.

SUMMARY OF THE INVENTION

Accordingly, it is an object of the present invention to provide a replaceable ink jet head mount which overcomes the disadvantages of the prior art.

Another object of the invention is to provide a replaceable ink jet head mount in which a relatively small force is required to assure electrical contact and maintain the head in position on a carriage.

These and other objects of the invention are attained by providing a replaceable ink jet head mount in which a head mounting-pad engagement force and an electrical connecting-pad engagement force are directed in opposite directions. In one embodiment, the mounting pads are located at a front surface of the head and the electrical contact pads are positioned at a rear surface of the head for engagement by a handle which contains electrical contacts and urges the mounting pads at the front surface of the head forwardly against corresponding mounting pads on a carriage. In another embodiment, a portion of the ink jet head has both forwardly-facing mounting pads and rearwardly-facing electrical contact pads and is received in a corresponding recess in a carriage in which rearwardly-facing mounting pads engage the forwardly-facing mounting pads of the ink jet head and forwardly-facing spring contacts engage the rearwardly-facing contacts of the ink jet head and a clamp provides a force which, together with the spring force, is sufficient to maintain the mounting pads in engagement during acceleration of the head.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
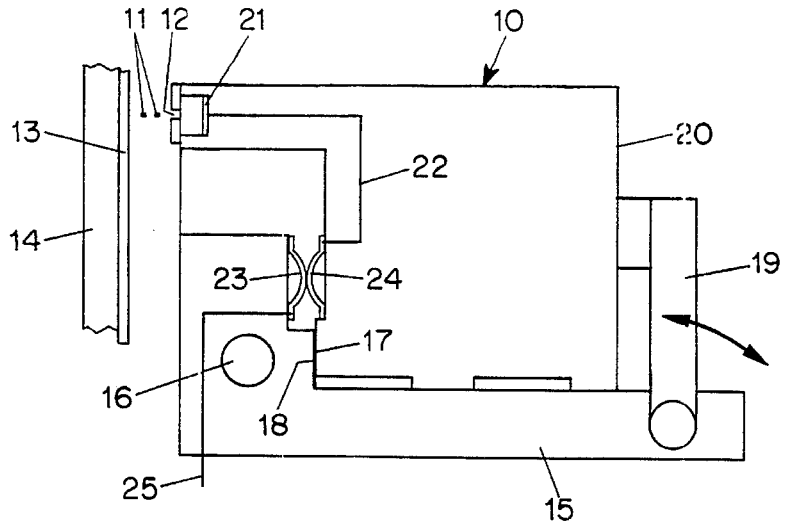
FIG. 1 (PRIOR ART)
FIG. 1 is a schematic side view showing a representative prior art mounting arrangement for a replaceable ink jet head.
Figure 2:
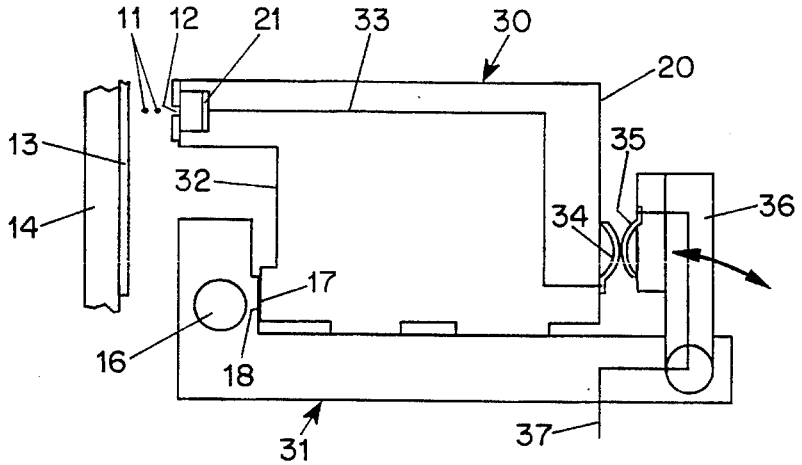
FIG. 2 is a schematic side view illustrating a representative mount for a replaceable ink jet head in accordance with the present invention.

In the typical embodiment of the invention shown in FIG. 2, a replaceable ink jet head 30 is mounted on a carriage 31 which is supported for reciprocating motion perpendicular to the plane of the drawing on a support bar 16 in the same manner described above with respect to FIG. 1. The replaceable ink jet head may, for example, be of the type described in the copending Hine application Ser. No. 08/143,165, filed Oct. 26, 1993, for "Ink Jet Head with Vacuum Reservoir" or in the copending Hoisington et al. application Ser. No. 08/143,166, filed Oct. 26, 1993, for "Ink Jet Head with Ink Usage Sensor", the disclosures of which are incorporated by reference herein.

As in the previously-described ink jet head of FIG. 1, a series of electromechanical transducers 21 is arranged to selectively eject ink drops 11 through a corresponding series of orifices 12 toward a substrate 13 supported on a platen 14 as the head travels in a reciprocal motion adjacent to the substrate. Moreover, as in the previously-described arrangement, the head 30 has forwardly-facing mounting pads 17 in the front surface 32 positioned to engage rearwardly-facing mounting pads 18 on the carriage 31 so as to position the head at a desired location on the carriage.

In accordance with the invention, the electromechanical transducers 21 are connected through a corresponding series of conductors 33 to a rearwardly-facing series of spring contacts 34 which are engaged by a corresponding series of contacts 35 in a handle 36 which is movable to apply force to urge the head 30 forwardly against the mounting pads 18, each of the contacts 35 being connected to a corresponding conductor 37 which leads to a control unit (not shown) for controlling the operation of the transducers 21.

With this arrangement, the force applied by the handle 36 to urge the electrical contacts 34 and 35 into engagement contributes to the force urging the mounting pads 17 of the head against the mounting pads 18 so that the total force required to be applied by the handle 36 must only exceed the greater of the mounting force required to prevent moving or shifting of the head under vibration, shock or acceleration, and the force required to assure electrical contact engagement. Thus, for an ink jet head with 96 electrical contact pads, each requiring 5 grams of force to assure engagement, thereby requiring a total of about 500 grams of force, and a 96-jet head 30 weighing 100 grams, which is subjected to a 5 G acceleration, the total force applied by the handle 36 need only exceed about 500 grams, i.e., approximately half the force required for a replaceable ink jet head of corresponding size arranged in the manner shown in FIG. 1.

Figure 3:
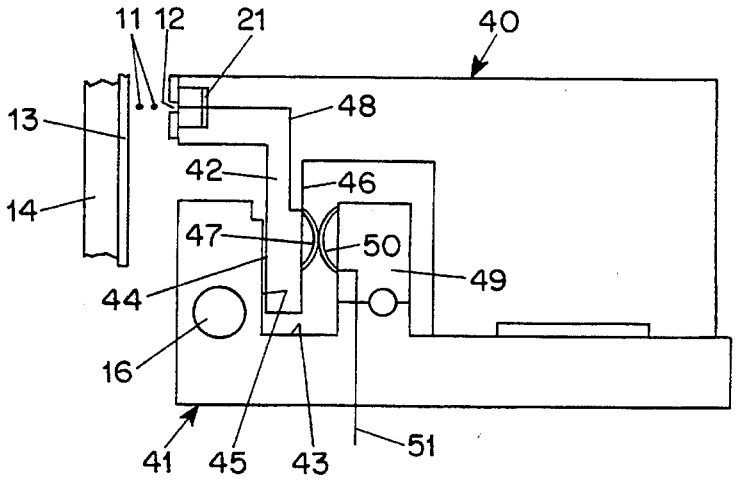
FIG. 3 is a side view illustrating a further representative embodiment of a mount for a replaceable ink jet head in accordance with the present invention.

In the further embodiment of the invention shown in FIG. 3, an ink jet head 40 having a series of electromechanical transducers 21 for selectively ejecting ink drops 11 through a corresponding series of orifices 12 toward a substrate 13 supported on a platen 14 is removably mounted on a carriage 41 which is supported on a support bar 16 for reciprocal motion perpendicular to the plane of the drawing. In this embodiment, the ink jet head 40 has a downwardly-projecting support portion 42 near the front end which is received in a corresponding mounting recess 43 in the carriage 41 with forwardly-facing mounting pads 44 on the support portion 42 engaging rearwardly-facing mounting pads 45 in the recess. On its rear surface 46, the support portion 42 has a series of flexible contact members 47 connected through corresponding conductors 48 to the transducers 21, and the rear surface of the recess 43 has a clamping member 49 with a corresponding series of forwardly-facing contact elements 50 connected through conductors 51 to a control unit (not shown). The clamping member 49, which may be a handle or a spring-biased member, is supported in the carriage 41 in position to engage the support portion 42 and to apply a force which is sufficient, together with the force applied by the springs 47 and 50 in the forward direction on the mounting portion 42, so as to maintain the mounting pads 44 and 45 in engagement during shock, vibration or acceleration of the head 40.

As in the FIG. 2 embodiment, the force applied by the clamping member 49 need only be greater than the larger of the forwardly-directed force required to maintain the pads 44 and 45 in engagement and the forwardly-directed force required to maintain good contact between the controls 47 and 50.

If the clamping member 49 is rigidly connected to the carriage 41 and the dimensions of the support portion 42 and the recess 43 and the dimensions and resilience of the springs 47 and 50 are appropriately selected, the entire mounting pad engagement force as well as the spring contact force may be provided by the contact springs 47 and 50 without requiring any additional clamping force. Thus, for example, with a head having 96 contact springs producing a total force of 500 grams in the forward direction on the mounting portion 42 and weighing 75 grams and subjected to a maximum acceleration of about 5 G's, the clamping force applied by the springs 47 and 50 in the forward direction may exceed the required mounting pad engagement force.

Although the invention has been described herein with reference to specific embodiments, many modifications and variations therein will readily occur to those skilled in the art. For example, rather than having forwardly-facing mounting pads on the replaceable ink jet head engaging rearwardly-facing mounting pads on the carriage and rearwardly-facing electrical contacts on the ink jet head engaging forwardly-facing contact members and a clamp providing a forwardly-directed clamping force, a reverse arrangement could be provided with the ink jet head having rearwardly-directed mounting surfaces engaging forwardly-directed mounting surfaces on the carriage and the electrical contacts and the clamping member could provide rearwardly-directed forces. Accordingly, all such variations and modifications are included within the intended scope of the invention.

I claim:

1. A mounting arrangement for a replaceable ink jet head comprising support means for supporting said ink jet head adjacent to a surface of a substrate, said replaceable ink jet head removably mounted on the support means and arranged to project ink drops selectively in a first direction toward the substrate, mounting pad means on the support means and on the ink jet head, respectively, for engagement with each other in a direction generally parallel to the first direction when the ink jet head is supported on the support means and which are releasably engageable by relative motion of the ink jet head and the support means in an engagement direction which is in the same direction as the first direction, electrical contact means on the ink jet head facing in a direction opposite to the engagement direction, and clamping means to urge the mounting pad means into engagement.

2. A mounting arrangement for a replaceable ink jet head comprising support means for supporting said ink jet head adjacent to a surface of a substrate, said replaceable ink jet head removably mounted on the support means and arranged to project ink drops selectively in a first direction toward the substrate, mounting pad means on the support means and on the ink jet head, respectively, for engagement with each other in a direction generally parallel to the first direction when the ink jet head is supported on the support means and which are releasably engageable by relative motion of the ink jet head and the support means in an engagement direction generally parallel to the first direction, electrical contact means on the ink jet head facing in a direction opposite to the engagement direction, and clamping means to urge the mounting pad means into engagement, wherein the clamping means is movable with respect to the support means and including second electrical contact means associated with the clamping means for engagement with the electrical contact means on the ink jet head to provide electrical contact therewith.

3. A mounting arrangement for a replaceable ink jet head comprising support means for supporting said ink jet head adjacent to a surface of a substrate, said replaceable ink jet head removably mounted on the support means and arranged to project ink drops selectively in a first direction toward the substrate, mounting pad means on the support means and on the ink jet head, respectively, for engagement with each other in a direction generally parallel to the first direction when the ink jet head is supported on the support means and which are releasably engageable by relative motion of the ink jet head and the support means in an engagement direction generally parallel to the first direction, electrical contact means on the ink jet head facing in a direction opposite to the engagement direction, and clamping means to urge the mounting pad means into engagement, including second electrical contact means associated with the support means for resilient engagement with the electrical contact means on the ink jet head to provide electrical contact therewith and to produce a force urging the ink jet head in the mounting pad engagement direction.

4. A mounting arrangement for a replaceable ink jet head in accordance with claim 3 including clamping means mounted on the support means and engageable with a portion of the ink jet head containing mounting pads for urging the mounting pads thereon toward corresponding mounting pads on the support means.

5. A mounting arrangement for a replaceable ink jet head comprising support means for supporting said ink jet head adjacent to a surface of a substrate, said replaceable ink jet head removably mounted on the support means and arranged to project ink drops selectively in a first direction toward the substrate, mounting pad means on the support means and on the ink jet head, respectively, for engagement with each other in a direction generally parallel to the first direction when the ink jet head is supported on the support means and which are releasably engageable by relative motion of the ink jet head and the support means in an engagement direction generally parallel to the first direction, electrical contact means on the ink jet head facing in a direction opposite to the engagement direction, and clamping means to urge the mounting pad means into engagement, including second electrical contact means mounted on the clamping means to provide electrical contact and a plurality of electrical conductors for connecting the second electrical contact means with a control means.

6. A mounting arrangement for a replaceable ink jet head comprising support means for supporting said ink jet head adjacent to a surface of a substrate, said replaceable ink jet head removably mounted on the support means and arranged to project ink drops selectively in a first direction toward the substrate, mounting pad means on the support means and on the ink jet head, respectively, for engagement with each other in a direction generally parallel to the first direction when the ink jet head is supported on the support means and which are releasably engageable by relative motion of the ink jet head and the support means in an engagement direction generally parallel to the first direction, electrical contact means on the ink jet head facing in a direction opposite to the engagement direction, and clamping means to urge the mounting pad means into engagement, wherein the mounting pad means includes forwardly-facing mounting pads disposed on a surface of the ink jet head facing the substrate and wherein the electrical contact means is disposed on a rearwardly-facing surface of the ink jet head facing away from the substrate.

7. A mounting arrangement for a replaceable ink jet head comprising support means for supporting said ink jet head adjacent to a surface of a substrate, a replaceable ink jet head removably mounted on the support means and arranged to project ink drops selectively in a first direction toward the substrate, mounting pad means on the support means and on the ink jet head, respectively, for engagement with each other in a direction generally parallel to the first direction when the ink jet head is supported on the support means and which are releasably engageable by relative motion of the ink jet head and the support means in an engagement direction generally parallel to the first direction, electrical contact means on the ink jet head facing in a direction opposite to the engagement direction, and clamping means to urge the mounting pad means into engagement, wherein the support means is provided with a recess extending parallel to engagement surfaces of the mounting pad means and wherein the ink jet head is provided with a projection arranged to be received in the recess in the support means and wherein the mounting pad means includes mounting pads disposed on facing surfaces of the recess and the projection, and including second electrical contact means disposed on a surface facing the electrical contact means to provide electrical contact therewith.

* * * * *